US005468119A

United States Patent [19]

Huebel et al.

[11] Patent Number: 5,468,119

[45] Date of Patent: Nov. 21, 1995

[54] PERIPHERAL PUMP, PARTICULARLY FOR FEEDING FUEL TO AN INTERNAL COMBUSTION ENGINE FROM A FUEL TANK OF A MOTOR VEHICLE

[75] Inventors: Michael Huebel; Klaus Reymann, both of Gerlingen, Germany

[73] Assignee: Robert Bosch GmbH, Stuttgart, Germany

[21] Appl. No.: 191,003

[22] Filed: Feb. 3, 1994

[30] Foreign Application Priority Data

Mar. 9, 1993 [DE] Germany ..... 43 07 353.0

[51] Int. Cl.[6] ..... F04D 5/00

[52] U.S. Cl. ..... 415/55.1; 415/55.5

[58] Field of Search ..... 415/55.1, 55.5; 416/223 A

[56] References Cited

U.S. PATENT DOCUMENTS

| | | | |
|---|---|---|---|
| 3,359,908 | 12/1967 | Toma | 415/55.1 |
| 4,204,802 | 5/1980 | Schonwald et al. | 415/55.1 |
| 5,123,809 | 6/1992 | Ito | 415/55.1 |
| 5,299,908 | 4/1994 | Robbie | 415/55.1 |
| 5,328,325 | 7/1994 | Strohl et al. | 415/55.1 |

FOREIGN PATENT DOCUMENTS

| | | | |
|---|---|---|---|
| 1005374 | 8/1957 | Germany . | |
| 0966487 | 8/1957 | Germany | 415/55.1 |
| 0111966 | 9/1944 | Sweden | 415/55.5 |

*Primary Examiner*—Edward K. Look
*Assistant Examiner*—Mark Sgantzos
*Attorney, Agent, or Firm*—Michael J. Striker

[57] ABSTRACT

The peripheral pump has a rotatable impeller including a central hub portion, an outer peripheral closed ring and impeller blades connecting the outer peripheral closed ring and the central hub portion to form intervening spaces between the blades; and a pump chamber having opposing chamber walls facing the impeller in the pump chamber, which are provided with ring-shaped ducts spaced radially from the impeller rotation axis to a same extent as the impeller blades and extending radially only to a radial extent equal to that of the impeller blades. The front side of each blade facing in the impeller rotation direction has a planar front surface extending from the central hub portion to the outer peripheral ring and a rear side of each blade has two blade edge surfaces inclined relative to respective opposing chamber walls and pointing to the respective chamber walls in the rotation direction of the impeller, at least in an edge region of the blade, to prevent turbulent flow in the intervening spaces. The blade edge surfaces also extend substantially radially and perpendicularly to the rotation axis.

13 Claims, 3 Drawing Sheets

Fig. 4
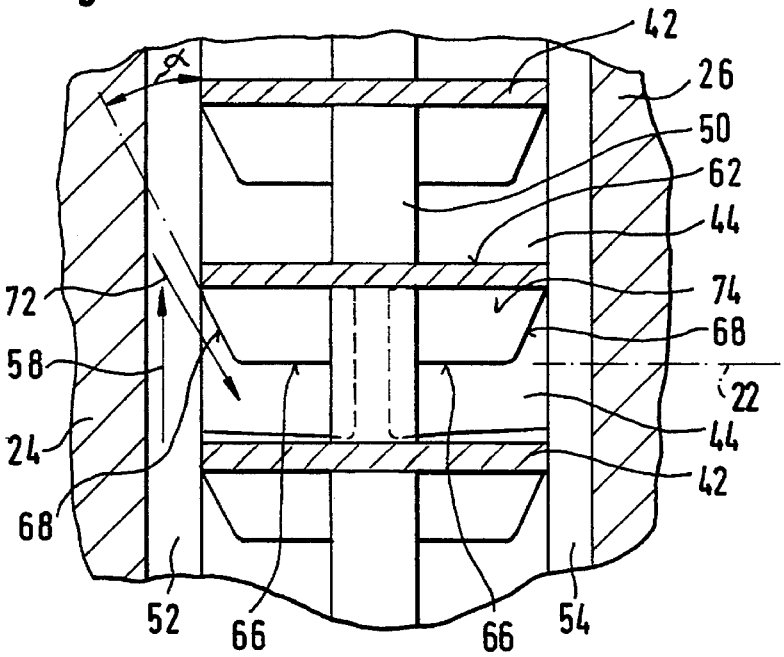
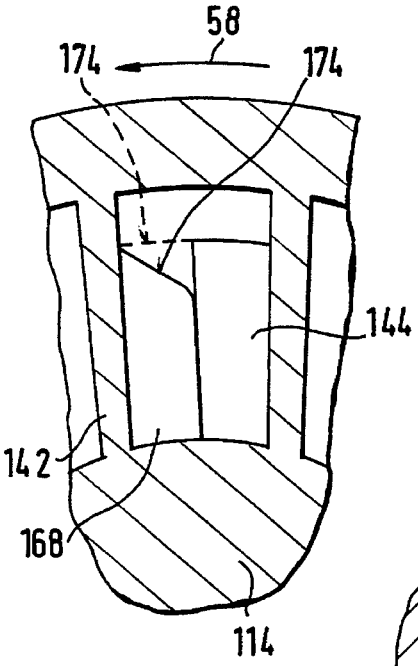
Fig. 5
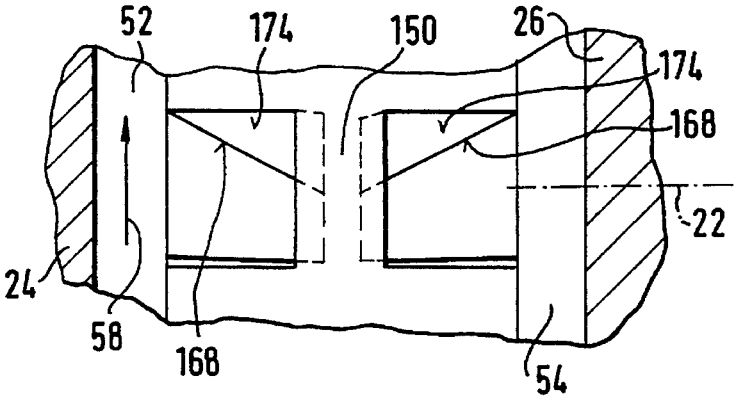
Fig. 6

PERIPHERAL PUMP, PARTICULARLY FOR FEEDING FUEL TO AN INTERNAL COMBUSTION ENGINE FROM A FUEL TANK OF A MOTOR VEHICLE

BACKGROUND OF THE INVENTION

The present invention relates to a peripheral pump and, more particularly, to a peripheral pump for feeding fuel to an internal combustion engine from a fuel tank of a motor vehicle.

A peripheral pump for feeding fuel from a tank of a motor vehicle to an internal combustion engine is known comprising an impeller rotatable in a rotation direction, having a rotation axis and including a plurality of blades extending radially from a rim of the impeller and spaced from each other in the rotation direction of the impeller; and a pump chamber for the impeller. The pump chamber has at least one chamber wall facing in a direction of the rotation axis. At least one chamber wall or walls have a ring-shaped duct therein spaced radially from the rotation axis to the same extent as the blades.

One example of the above-described type of peripheral pump is described in German Patent 10 05 374. This peripheral pump has an impeller rotatable in a pump chamber which has a rim from which a plurality of blades extend radially spaced from each other. The pump chamber is bounded by two walls which face in a direction along a rotation axis of the impeller, a ring-shaped entrance duct for fluid flow being formed in at least one of the two walls. The rear side of each blade directed opposite to the rotation direction of the blade has a curved surface as seen in a tangential cross-section taken along the impeller periphery. Thus the surface on the rear side of the blade can be viewed as inclined on average relative to the bounding wall, so that the surface in an edge region facing the chamber wall is directed oppositely to the rotation direction of the impeller. The front side of each blade directed in the rotation direction of the impeller is similarly curved, so its edge region pointing at the bounding wall leads the edge region pointing away from the bounding wall. The flow of the medium to be pumped into the intervening space between the blades occurs from the duct formed in the bounding wall in a direction opposite to the rotation of the impeller. Because of the curved structure of the rear side of the blade, the flow of the medium into the intervening spaces formed between the blades is not parallel to the surface of the rear side of the blade so that nonlaminar flow occurs on the rear side of the blade and turbulence occurs, which is drawn from the kinetic energy of flow and is dissipated as heat. These loses, so-called shock losses, reduce the pressure head obtained and the efficiency of the pump.

SUMMARY OF THE INVENTION

It is an object of the present invention to provide a peripheral pump of the above-described type, particularly for feeding fuel from the tank of a motor vehicle to an internal combustion engine, which has none of the above-described disadvantages.

According to the invention, the peripheral pump comprises a rotatable impeller having a rotation axis and including a central hub portion, an outer peripheral closed ring and a plurality of blades in a peripheral portion thereof connecting the outer peripheral closed ring and the central hub portion to form a plurality of intervening spaces between the blades, and a pump chamber having at least one chamber wall facing in a direction along the rotation axis, the impeller being positioned in the pump chamber, and the at least one chamber wall having a ring-shaped duct therein spaced radially from the impeller rotation axis to a same extent as the blades are spaced from the impeller rotation axis and extending radially only from the central hub portion to the outer peripheral closed ring so that the ring-shaped duct has a radial extent equal to that of the blades; wherein a front side of each blade facing in the impeller rotation direction has a planar front surface extending from the central hub portion to the outer peripheral closed ring; and a rear side of each blade facing opposite to the impeller rotation direction has at least one blade edge surface inclined relative to the at least one chamber wall and pointing to the at least one chamber wall in the impeller rotation direction, at least in an edge.

The peripheral pump with the above-described features according to the invention has the advantage that turbulent flow in the intervening spaces between the blades is substantially prevented by forming the at least one blade edge surface in the edge region of the rear side facing the ring-shaped duct in the neighboring chamber wall on the rear side of the blade, which is inclined relative to the rotation direction of the impeller, in a suitable manner. Because the turbulent flow is eliminated, the pump head obtained and the operational efficiency of the peripheral pump are improved.

Various preferred embodiments of the invention are possible. Advantageously both edge regions of each of the impeller blades face two chamber walls forming the pump chamber and have substantially planar blade edge surfaces. In a preferred embodiment these blade edge surfaces extend substantially radially and perpendicular to the impeller rotation axis.

The rear side of each of the impeller blades has an approximately planar rear surface extending substantially parallel to the rotation axis and connecting the blade edge surfaces facing the two opposing chamber walls.

It is particularly advantageous when each blade edge surface is planar and oriented at an acute angle to its associated chamber wall of from about 20 ° to 40°.

In other preferred embodiments the rear side of each of the blades has an additional approximately planar rear surface positioned radially exterior to and connected to the approximately planar rear surface which is inclined relative to the approximately planar rear surface and has a radially exterior edge portion pointing in the rotation direction of the impeller. In this embodiment the blade edge surfaces extend only in a comparatively narrow edge region along opposite sides of the blade. In other embodiments only a single planar rear surface need be provided since the blade edge surfaces can be extended so far from each of their respective edges that they nearly or completely extend to a central connecting member of the blades.

The transitional regions between the surfaces can be rounded.

BRIEF DESCRIPTION OF THE DRAWING

The objects, features and advantages of the present invention will now be illustrated in more detail by the following detailed description, reference being made to the accompanying drawing in which:

FIG. 4 is a detailed tangential cross-sectional view of the peripheral pump of FIG. 1 taken along the section line IV—IV in FIG. 2;

FIG. 5 is a detailed cross-sectional view, similar to FIG. 3, of another embodiment of the peripheral pump according to the invention having a different impeller blade structure; and FIG. 6 is a detailed cross-section view, similar to FIG. 4, of the additional embodiment of the peripheral pump shown in FIG. 5.

DESCRIPTION OF THE PREFERRED EMBODIMENTS

Figure 1:
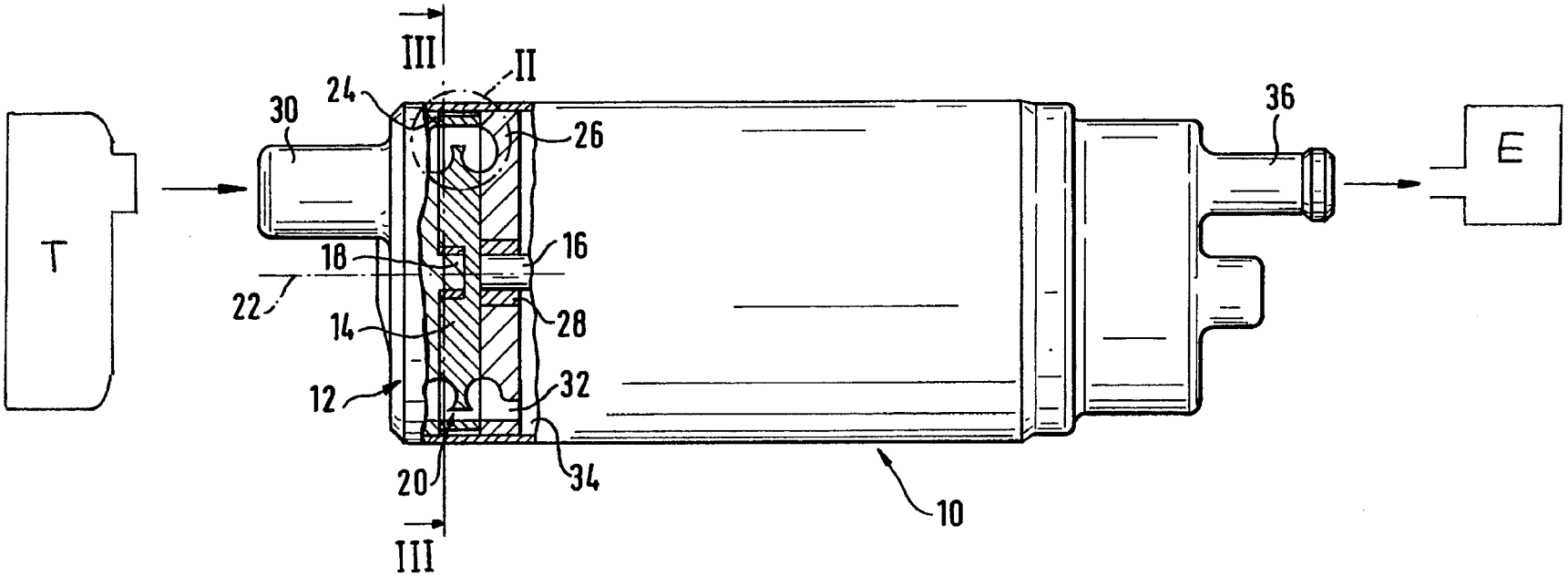
FIG. 1 is a partially side, partially cross-sectional view through a fuel supply apparatus including a peripheral pump according to the invention.

One embodiment of the peripheral pump 12 according to the invention is shown in FIGS. 1 to 4. A second preferred embodiment of the pump is shown in FIGS. 5 and 6.

A fuel supply apparatus 10 feeds fuel from a fuel tank T of a motor vehicle to an internal combustion engine E. The fuel supply apparatus 10 includes a peripheral pump 12, whose impeller 14 is connected nonrotatably with a drive shaft 16 of an electric drive motor not shown in detail in the drawing. The rotatable impeller 14 is made of plastic, sits on a bearing pin 18 and is located in a pump chamber 20. The pump chamber 20 is bounded, in a direction of a rotation axis 22 of the impeller, on respective opposite sides by chamber walls 24 and 26 of the housing. The bearing pin 18 is formed on the chamber wall 24 and the chamber wall 26 has a bearing 28 for the drive shaft 16 of the drive motor. During operation of the fuel supply apparatus 10 the peripheral pump 12 draws fuel through a vacuum connector pipe 30 and forces it through a pump outlet 32 in the chamber wall 26 into a compartment 34 in which the unshown drive motor is accommodated. From there the fuel is fed through an outlet pipe 36 to the internal combustion engine E.

Figure 3:
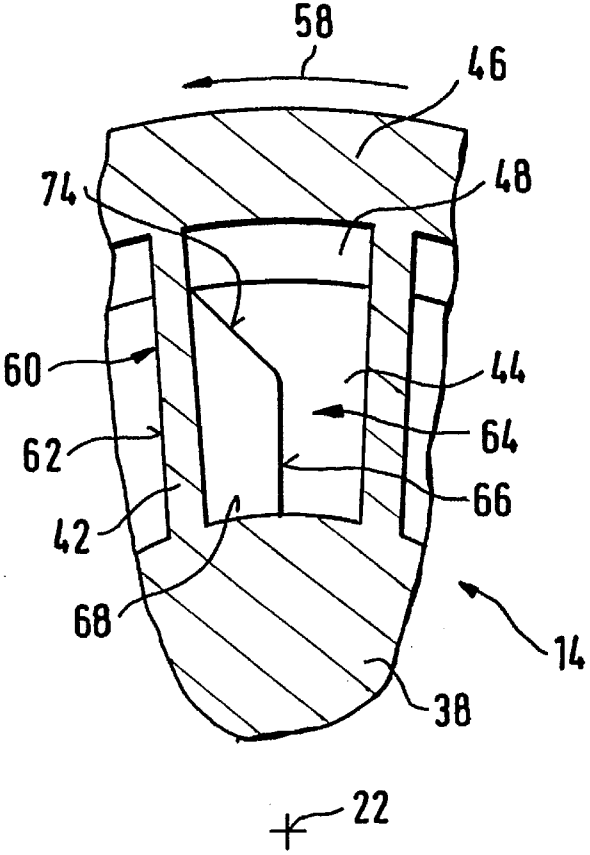
FIG. 3 is a detailed cross-sectional view through the peripheral pump of FIG. 1 taken along the section line III—III in FIG. 1.

The impeller 14 is shown in more detail in a cross-section in FIG. 3 taken perpendicular to the rotation axis 22 of the impeller 14. The impeller 14 has a central hub portion 38, in which a bearing sleeve is provided in which the bearing pin 18 engages. The central hub portion 38 of the impeller 14 has a plurality of radially extending blades 42 distributed around its circumference and connecting the central hub portion 38 to a circular member or ring 46. Intervening spaces 44 are formed between adjacent blades 42 of the impeller. The outer peripheral closed ring 46 connected to the blades 42 is radially exterior to the blades 42 and bounds intervening spaces 44 on a radially exterior side of the intervening space. A connecting member 50 extends in the vicinity of the intervening space 44, which however does not extend radially as far as the outer peripheral closed ring 46, so that a flow passage 48 across the impeller 14 is formed between the connecting member 50 and the outer peripheral closed ring 46.

Figure 2:
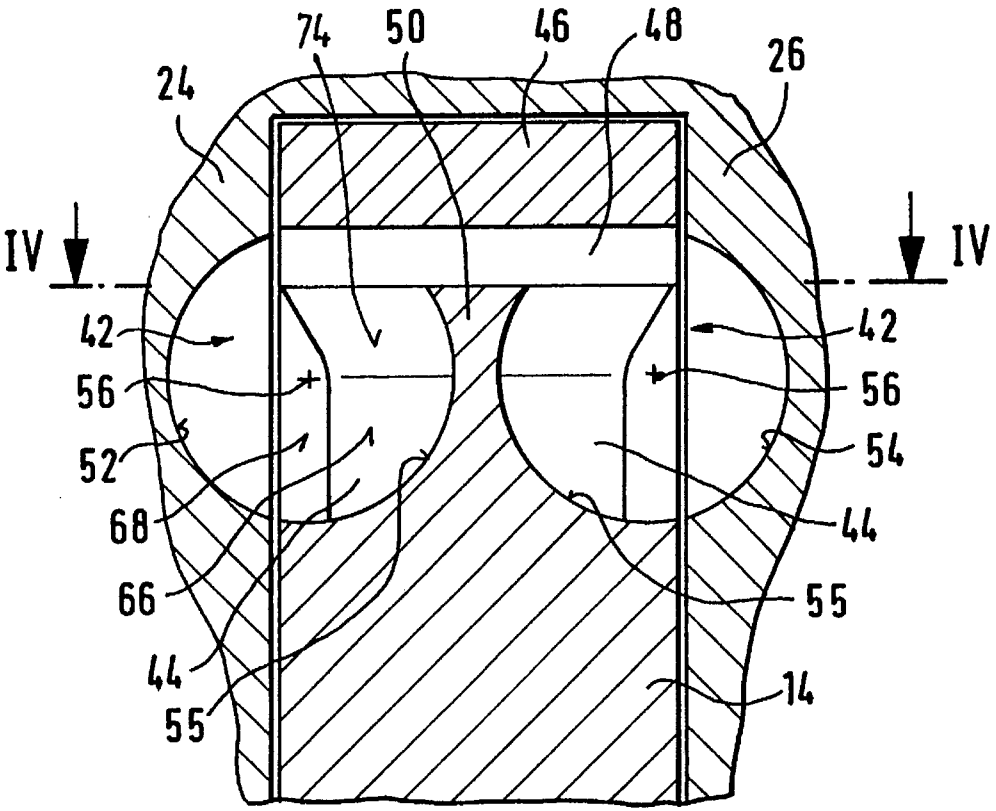
FIG. 2 is a detailed cross-sectional view through the portion of the peripheral pump of FIG. 1 in the dot-dashed circle labelled II in FIG. 1.

From FIG. 2 it is apparent that the impeller 14 has a rim on both opposing surfaces with the blades 42. Both opposing faces of the blade 42 are separated from each other in the direction of the rotation axis 22 by the connecting member 50 dividing the impeller centrally. The intervening spaces 44 partially separated from each other by the connecting member 50 are connected by the passage 48. Circular ducts 52 and 54 are formed in the axially bounding chamber walls 24 and 26, which have a semicircular cross-section in the axial longitudinal cross-section containing the rotation axis 22 and which extend around the circumference of the impeller 14 in the same way as the blades 42. The outer ring 46 of the impeller 14 extends radially to the radial outer edge of the circular ducts 52 and 54. The intervening spaces 44 between the blades 42 are formed so that they appear groove-like in axial longitudinal cross-section through the peripheral pump 12 and have a base surface 55 having a circular arc shaped cross-section. The semicircular cross-section of the circular duct 52 or 54 and the circular arc-shaped cross-section of neighboring base 55 of the intervening space 44 have common center 56, which is inside the contour of the impeller 14.

From FIG. 3 it is apparent that the front side 60 of each impeller blade 42 facing in the rotation direction 58 of the impeller 14 has a substantially plane surface 62 directed in a rotation direction 58 of the impeller 14, which extends approximately radially in a transverse cross-section perpendicular to the rotation axis 22 of the impeller 14. In the embodiment shown in FIGS. 1 to 4 the radial extent of the blades from the central hub portion 38 to the outer peripheral closed ring 46 just matches the radial extent of the circular ducts 52 and 54 in the chamber walls as shown for example in FIGS. 2 and 3.

As seen from FIG. 4, the surfaces of the front side 60 are approximately parallel to the rotation axis 22 of the impeller 14. The front surface 62 in the embodiment shown in the drawing which extends from the central hub portion 38 to the outer peripheral closed ring 46 is planar. The rear side 64 directed opposite to the rotation direction 58 of each blade 42 has a protruding body, which, in the embodiment shown in FIGS. 1 to 4, is bounded by three differently oriented surfaces 66, 68 and 74 respectively, arising from a surface parallel to the front surface 62. In FIG. 4 the course of these three surfaces is shown in a tangential cross-section through the impeller 14. A planar rear surface 66 bounding the body on the rear side facing opposite to the rotation direction 58 extends to the connecting member 50 in a central region of the impeller 14 and runs approximately parallel to the rotation axis 22 and is substantially planar, but can be formed in another embodiment so that it bulges out somewhat or somewhat convex. The protruding body at the adjoining chamber wall 24 and/or 26 is bounded by a second or blade edge surface 68 connected to the planar rear surface 66. The blade edge surfaces 68 are inclined relative to the planar surface 66 and inclined relative to the opposing surfaces of the chamber walls 24 perpendicular to the rotation axis 22 and of course is directed in the rotation direction so that the protruding body tapers toward the facing or opposing surfaces of the bounding chamber walls 24 and 26 in the rotation direction 58 of the impeller 14. In the embodiment shown in the drawing the inclined blade edge surfaces 68 are planar but they can also be shaped so that they bulge out somewhat or are somewhat convex. Each blade edge surface 68 is inclined at an acute angle $\alpha$ to the opposing surfaces of the bounding chamber walls 24 and/or 26 and the width of the protruding body to the bounding wall 24 and/or 26 across the impeller, reduces itself in the direction of the rotation axis 22. The angle $\alpha$ amounts to between 20 and 40 degrees. The inclined blade edge surfaces 68 form an inlet regions for ducts 52 and 54 formed in the chamber walls 24 and 26 through which fuel flows into the intervening space 44. The fuel flows into the intervening space 44 approximately in the direction indicted in FIG. 4 by the arrow 72 approximately parallel to the blade edge surface 68. The transitional region between the planar rear surface 66 and the blade edge surface 68 is rounded. Moreover the bulging body is bounded toward the radial exterior by another planar rear surface 74 as seen in FIG. 4.

In FIG. 3 the front surface 62 of a blade 42 is seen in a cross-section perpendicular to the rotation axis 22 through the impeller and is substantially planar as shown in FIG. 3. The blade edge surface 68 extends approximately radially to the rotation axis 22. The planar rear surface 66 extends similarly approximately radially to the rotation axis from the inner edge of the intervening space to the rotation axis 22. The planar rear surface 66 extends in a radial direction approximately to the center of the radial extent of the intervening space 44. The additional planar rear surface 74 connects to the planar rear surface 66 and is inclined relative to the planar rear surface 66 in the direction of rotation 58 of the impeller 14. The additional planar rear surface 74 is planar in the embodiment shown in the drawing, but it can however also be bulged out somewhat or somewhat convex. The additional planar rear surface 74 extends radially outwardly until at the height of the radially exterior end of the connecting member 50. The width, which the protruding body has in the circumferential direction on the impeller 14, decreases thus as one moves radially outwardly. The transitional region between the planar rear surface 66 and the additional planar rear surface 74 is also rounded.

In FIGS. 5 and 6 another embodiment of the peripheral pump 12 is shown, in which the protruding body on the rear side of the blade 142 has only two different types of surfaces. These surfaces comprise a planar rear surface 174 corresponding to the additional planar rear surface 74 and a blade edge surfaces 168 corresponding to the blade edge surface 68 of the embodiment of FIGS. 1 to 4. These surfaces 168 extend from the opposing surfaces of the impeller facing the chamber walls 24 and 26 to the connecting member 150. The blade edge surfaces 168 are substantially planar and are inclined in the rotation direction 58 relative to the opposing surfaces of the chamber walls 24 and 26. The inclined surface 168 forms an entrance region in the vicinity of their edges facing the chamber walls 24 and 26 for the fuel flowing into the intervening space 144 from the ducts 52 and 54 formed in the bounding chamber walls 24 and 26 like the blade edge surface 68 in the previously described embodiment. The planar rear surface 174 is inclined as seen in FIG. 6 with its radially furthest exterior end pointing in the rotation direction 58 of the impeller and is substantially planar. The surface 174 can also be curved and, as shown by the dashed lines in FIG. 6, extends to the same extent from the rotation axis 22, as the radially exterior end of the connecting member 150. Finally the planar rear surface 174 is also planar and is approximately tangential to the rotation axis 22.

While the invention has been illustrated and described as embodied in a peripheral pump, particularly for feeding fuel to an internal combustion engine from a fuel tank of a motor vehicle, it is not intended to be limited to the details shown in the examples, since various modifications and compositional changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

What is claimed is:

1. Peripheral pump comprising an impeller rotatable in a rotation direction, having a rotation axis and including a central hub portion, an outer peripheral closed ring and a plurality of blades in a peripheral portion thereof and spaced from each other in the rotation direction of the impeller, said blades connecting said outer peripheral closed ring and said central hub portion so as to form a plurality of intervening spaces, each of said intervening spaces being located between adjacent ones of said blades;

a pump chamber having at least one chamber wall facing in a direction of said rotation axis, said impeller being positioned in said pump chamber, and said at least one chamber wall having a ring-shaped duct therein spaced radially from said rotation axis to a same extent as said blades are spaced from said rotation axis and said ring-shaped duct extending radially only from said central hub portion to said outer peripheral closed ring so that said ring-shaped duct has a radial extent equal to that of said blades;

wherein a front side of each of said blades facing in said rotation direction of said impeller has a planar front surface extending from said central hub portion to said outer peripheral ring; and wherein a rear side of each of said blades facing opposite to said rotation direction of said impeller has at least one blade edge surface inclined relative to said at least one chamber wall and pointing to said at least one chamber wall in said rotation direction of said impeller, at least in an edge region of said blade, to prevent turbulent flow in said intervening space.

2. Peripheral pump comprising an impeller rotatable in a rotation direction, having a rotation axis and including a central hub portion, an outer peripheral closed ring and a plurality of blades in a peripheral portion thereof and spaced from each other in the rotation direction of the impeller, said blades connecting said outer peripheral closed ring and said central hub portion to form a plurality of intervening spaces, each of said intervening spaces being located between adjacent ones of said blades;

a pump chamber having at least one chamber wall facing in a direction of said rotation axis, said impeller being positioned in said pump chamber, and said at least one chamber wall having a ring-shaped duct therein spaced radially from said rotation axis to a same extent as said blades are spaced from said rotation axis and said ring-shaped duct extending radially only from said central hub portion to said outer peripheral closed ring so that said ring-shaped duct has a radial extent equal to that of said blades;

wherein a front side of each of said blades facing in said rotation direction of said impeller has a planar front surface extending from said central hub portion to said outer peripheral ring; and wherein a rear side of each of said blades facing opposite to said rotation direction of said impeller has at least one blade edge surface inclined relative to said at least one chamber wall and pointing to said at least one chamber wall in said rotation direction of said impeller, at least in an edge region of said blade, to prevent turbulent flow in said intervening space and wherein said at least one blade edge surface is substantially planar and extends substantially radially to said rotation axis.

3. Peripheral pump as defined in claim 1, further comprising means for feeding fuel from a fuel tank of a motor vehicle to an internal combustion engine of said motor vehicle.

4. Peripheral pump as defined in claim 1, wherein said at least one blade edge surface is substantially planar.

5. Peripheral pump as defined in claim 2 wherein said rear side of each of said blades has an approximately planar rear surface extending substantially parallel to said rotation axis, said approximately planar rear surface connecting to said at least one blade edge surface, said at least one blade edge surface extending only in said edge region of said blade.

6. Peripheral pump as defined in claim 5, wherein said at least one blade edge surface is inclined at an acute angle to said at least one chamber wall.

7. Peripheral pump as defined in claim 6, wherein said acute angle is from about 20° to 40°.

8. Peripheral pump as defined in claim 5, wherein said at least one blade edge surface extends circumferentially to approximately a middle portion of said intervening space.

9. Peripheral pump as defined in claim 5, wherein said planar rear surface extends approximately radially from said rotation axis on each of said blades.

10. Peripheral pump as defined in claim 9, wherein said rear side of each of said blades has an additional approximately planar rear surface positioned radially exterior to and connected to said approximately planar rear surface, said additional approximately planar surface being inclined relative to said approximately planar rear surface and having a radially exterior edge portion pointing in said rotation direction of said impeller.

11. Peripheral pump as defined in claim 10, wherein each of said intervening spaces has a groove-like base portion having a circular-arc shaped cross-section in a longitudinal plane of said impeller, said longitudinal plane including said rotation axis, and said circular arc-shaped cross-section having a circle center and said approximately planar rear surface extending in a radial direction from said rotation axis to a radial height from said rotation axis of said circle center.

12. Peripheral pump as defined in claim 5, wherein at least one transitional region is provided between said planar rear surface and said at least one blade edge surface and said at least one transitional region is rounded.

13. Peripheral pump as defined in claim 10, wherein a plurality of transitional regions are provided between said planar rear surfaces and said at least one blade edge surface and said transitional regions are rounded.

* * * * *